US012545479B2

(12) United States Patent
Geiger

(10) Patent No.: US 12,545,479 B2
(45) Date of Patent: Feb. 10, 2026

(54) CONTAINER WITH SUPPORT AND FIXATION FOR A LID

(71) Applicant: Frederic Geiger, Lörrach (DE)

(72) Inventor: Frederic Geiger, Lörrach (DE)

( * ) Notice: Subject to any disclaimer, the term of this patent is extended or adjusted under 35 U.S.C. 154(b) by 43 days.

(21) Appl. No.: 18/564,214

(22) PCT Filed: May 17, 2022

(86) PCT No.: PCT/DE2022/100370

§ 371 (c)(1),
(2) Date: Nov. 27, 2023

(87) PCT Pub. No.: WO2022/247987

PCT Pub. Date: Dec. 1, 2022

(65) Prior Publication Data

US 2024/0246731 A1 Jul. 25, 2024

(30) Foreign Application Priority Data

May 25, 2021 (DE) ..... 10 2021 113 399.8

(51) Int. Cl.
*B65D 43/02* (2006.01)
*B65D 77/20* (2006.01)

(52) U.S. Cl.
CPC ..... *B65D 43/0202* (2013.01); *B65D 77/2004* (2013.01); *B65D 2543/00101* (2013.01); *B65D 2543/0049* (2013.01); *B65D 2543/00546* (2013.01); *B65D 2543/00574* (2013.01)

(58) Field of Classification Search
CPC ..... B65D 43/0202; B65D 77/2004; B65D 2543/00101; B65D 2543/0049; B65D 2543/00546; B65D 2543/00574
USPC ..... 229/125.22
See application file for complete search history.

(56) References Cited

U.S. PATENT DOCUMENTS 910,551 A * 1/1909 Lehmann ..... B65D 5/46008 229/117.11
1,157,733 A * 10/1915 Stevenson ..... B65D 5/6697 220/4.24
1,725,526 A * 8/1929 Kondolf ..... B65D 5/4283 53/145

(Continued)

FOREIGN PATENT DOCUMENTS

CN 213324249 U * 6/2021
DE 905110 C 2/1954

(Continued)

OTHER PUBLICATIONS

German Patent Office, Search Report issued in corresponding Appl. No. DE 10 2021 113 399.8 dated Feb. 7, 2022, 7 pages.

(Continued)

*Primary Examiner* — James N Smalley
(74) *Attorney, Agent, or Firm* — Brett A. Schenck

(57) ABSTRACT

The present invention relates to a storage box with a base body, having side walls, a cover, especially a lid, and a fastening device for the cover, wherein the fastening device has at least one elastic tension element, wherein the cover can be fixed relative to the storage box by means of the tension element and wherein the elastic tension element is guided in sections on an inside of the side walls and thereby provides an internal support for the cover on the storage box.

12 Claims, 7 Drawing Sheets

(56) References Cited

U.S. PATENT DOCUMENTS

Figure 1:
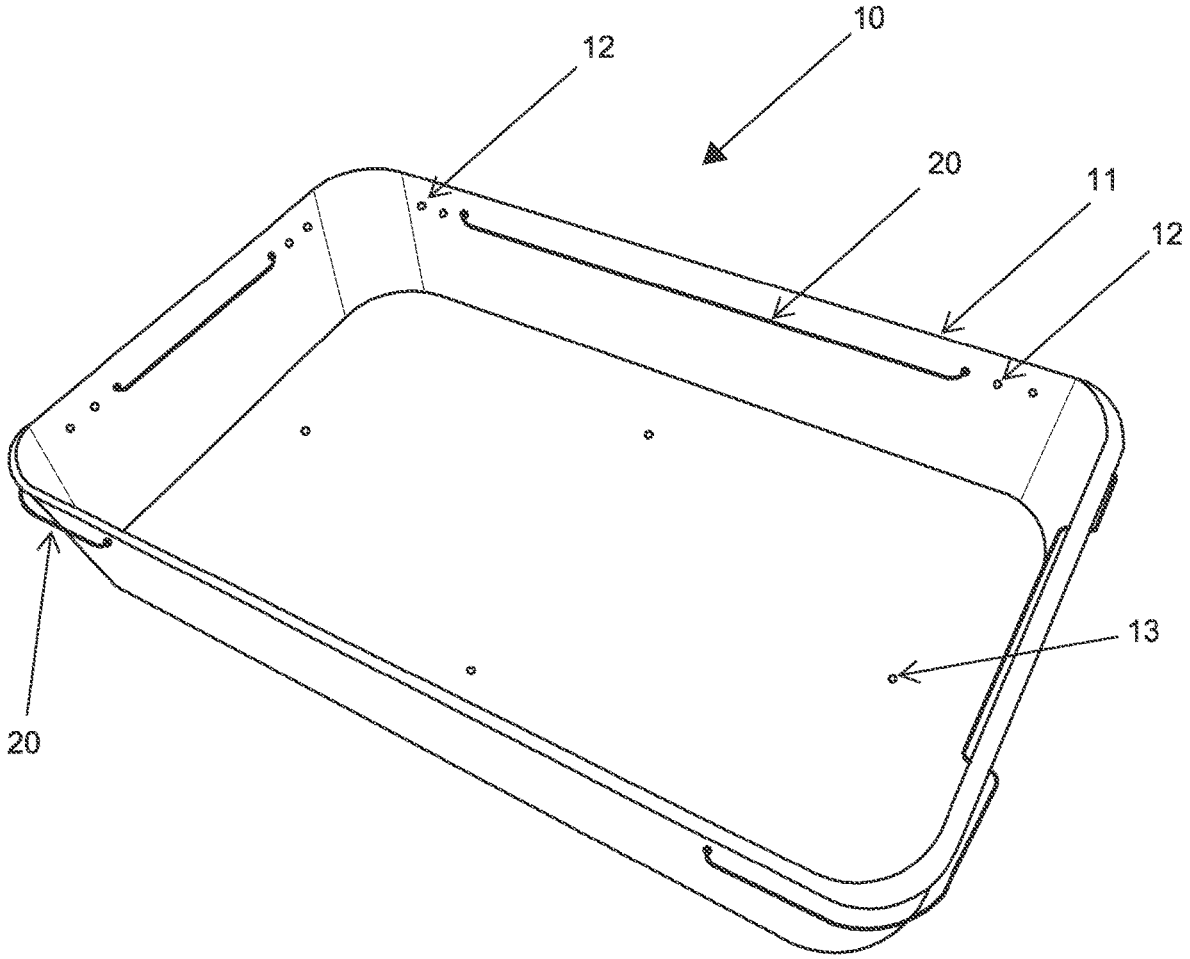

| | | | | |
|---|---|---|---|---|
| 2,340,124 | A * | 1/1944 | Hoyt | B65D 1/22<br>229/125.36 |
| 2,810,511 | A | 10/1957 | Cantor | |
| 4,009,897 | A | 3/1977 | Spellman | |
| 9,051,096 | B2 * | 6/2015 | Tuan | A45C 13/1084 |
| 2003/0226846 | A1 * | 12/2003 | Horwath | B65F 1/16<br>150/154 |
| 2007/0227929 | A1 * | 10/2007 | Mauerhan | B65D 5/68<br>220/376 |
| 2010/0032473 | A1 * | 2/2010 | Grassia | B42F 7/02<br>229/67.1 |

FOREIGN PATENT DOCUMENTS

| | | | |
|---|---|---|---|
| EP | 0520885 | A1 | 12/1992 |
| FR | 341768 | A | 8/1904 |
| JP | H0885560 | A | 4/1996 |
| JP | 2002019808 | A | 1/2002 |

OTHER PUBLICATIONS

WIPO/ISA/EPO, International Search Report issued in corresponding International Appl. No. PCT/DE2022/100370 dated Sep. 5, 2022, 2 pages.

* cited by examiner

CONTAINER WITH SUPPORT AND FIXATION FOR A LID

The present invention relates to a storage box according to the preamble of claim 1. Such a storage box is formed with a base body, which has side walls and a cover, in particular a lid, and is provided with a fastening device for the cover.

A variety of storage boxes with covers are known. With these storage boxes, the question of how to attach the cover to the storage box is basically raised. For this, a number of means are known, such as clips provided on the cover that can be attached to a projection of the base body of the storage boxes, retaining brackets, adhesive connections, frictional connections, and the like.

All these possibilities of attaching a cover to a storage box have the common disadvantage that on the one hand the fastening means for the cover on the box are designed as a movable or separate but firmly connected part, which results in increased costs for the production of the storage box. In particular with movable but firmly connected parts, it is known that after repeated use the material between the fastening clip and the cover or the storage box becomes brittle and after a specific number of opening or closing operations the fastening possibility loses its structural integrity.

With the individual shape designs of storage boxes and their covers usually on the market, the box becomes completely unusable if the individual locking mechanism has a defect. In addition, a special shape design is often utilized in the edge area of the storage boxes in order to create a support area for the cover on the storage box. The support area and the cover regularly have to have a well-coordinated shape.

The present invention is based on the task of providing a storage box with a cover, in which the attachment of the cover to the storage box and the support area for the cover on the storage box is provided by simple means and can be easily reproduced.

The task is solved according to the present invention by a storage box with the characterizing features of claim 1. These are:

that the fastening device has at least one elastic tensioning element, that the cover can be fixed relative to the storage box by means of the tensioning element and that the elastic tensioning element is guided in areas on an inside of the side walls and thereby provides an internal support for the cover on the storage box.

It is recognized that the invention is at least realized when a storage box is provided in an area near the opening with an elastic element or band, which is guided regionally between the inside of the side walls of the storage box and the outside of the side walls of the storage box. The elastic element or band is preferentially guided in the area of the corners/edges where the side walls meet, on an outside of the side walls. The area near the opening can correspond approximately to a thickness of the cover, whereby a flush closure of the cover with the edges of the side walls of the storage box can be formed. However, this is not technically mandatory.

According to a preferred further development of the present invention, it is provided that the elastic tension element is guided through recesses in the side walls and is arranged regionally inside and outside the storage box.

Through this regional guidance of the elastic tension element both on an inside and on an outside of the side walls, the elastic tension element can serve as a support for the cover of the storage box. Also, this allows the attachment of the cover to the storage box by slipping the areas of the elastic tension element guided on an outside in the corner areas of the side walls over the respective corners of the cover. As a result, the cover can be fixed between the inner areas of the elastic tension element and the outer, slipped-over areas of the elastic tension element.

It is particularly preferred that the cover in its dimensions is smaller than the internal dimensions of the body of the storage box. According to one design, the cover, if the elastic tension element is not provided, can fall into an inner area of the storage box at least to a specific depth. The inner areas of the elastic tension element can prevent this and provide a support surface of defined height for the cover within the body relative to the opening of the storage box.

The recesses can be millings or drillings in the side walls of the body. Particularly useful is a recess in the side walls of the body, which allows the elastic tension element to be provided with a transition from an inside to an outside of the side walls of the body of the storage box, in which an upper edge of the side walls facing the opening of the storage box remains free from the at least one elastic tension element. The recess can thus provide a passage for the elastic element through the side wall.

Preferably, at least two holes can be provided along each side wall in an upper area of the body facing the opening of the storage box, through which the elastic tension element is guided.

It is conveniently provided that the cover can be fixed between the sections of the elastic element that are inside and outside the storage box.

According to a preferred further development of the present invention, it is provided that the elastic element is guided in the corners between the side walls of the storage box on an outer side of the storage box. The side walls of the storage box can have edges along which the individual side walls meet. In this area, the elastic tension element can ideally be guided on an outer side of the body of the storage box. This allows the respective part of the elastic tension element provided in the area of the edges to be guided over the corresponding corners of a placed cover or to be slipped over. By slipping over the elastic element in at least one, ideally several edge areas, the cover can be secured on the body of the storage box. If you turn the storage box with the cover upside down, the cover ideally remains fixed to the body of the storage box.

Consequently, according to a useful further development of the present invention, it is provided that the elastic element can be slipped over the corners of the cover to fix the cover.

According to a particularly preferred further development of the present invention, it is provided that just a single elastic element is guided ornamentally through the recesses of the storage box, especially the side walls.

In principle, one or more elastic elements can be guided through the recesses in the side walls of the storage box. These can either be guided at least partially parallel to each other or in separate sections of the side walls through the recesses.

According to a further development of the present invention, at least two elastic tension elements can be provided, each extending over at least two adjacent side walls of the body of the storage box.

Regardless of whether one elastic tension element or several elastic tension elements are provided on the storage box as a fastening and/or support for the cover, the end areas of each elastic tension element can be attached to/opposite the body of the storage box. Such a fastening can ideally be provided in the area of a recess, where the elastic tension element is provided with a thickening that is larger than the diameter of the recess. The thickening can, for example, be a knot or an additional element such as a clip, which is larger in diameter than the diameter of the recess itself in at least one orientation.

By such a determination of the at least one elastic tension element, the elastic tension element can be provided on the base body of the storage box with an arbitrarily adjustable preload. This preload can be used to adjust the force with which the elastic tension element holds the cover on the base body of the storage box. According to a preferred implementation of the present innovation, the at least one elastic tension element is, for example, a rubber band or a textile-covered elastic band. For an even distribution of force of the elastic tension element, it can be provided with a round cross-section.

An advantageous development of the present innovation is that at least one, but ideally two, and particularly preferred at least three or four sections of the elastic element, which are outside the corners, are guided on/along an inside of the storage box, especially along an inside of the sidewalls.

By guiding the elastic tension element along the inside(s) of the sidewalls, a support area or a support edge for the cover of the storage box is provided in this area. An advantageous support of the cover on the internal areas of the elastic tension element may require that the cover is smaller than the opening of the storage box, but large enough not to fall past the internal elastic tension elements into the interior of the storage box.

Already by two opposing internal areas of the elastic tension element, sufficient support for the cover can be provided. By stretching areas of the elastic tension element along the edges between the sidewalls, the lid, as soon as it is placed on the internal areas of the elastic tension element, can be fixed relative to the storage box between the internal areas of the elastic tension element and the stretched areas of the elastic tension element in the area of the corners.

It is expediently provided that the at least one elastic element is arranged in an upper edge area below an opening of the storage box, which corresponds approximately to the thickness or depth of the cover. Here, the distance between the opening of the storage box and the internally guided elastic element can ideally correspond to at least the thickness of the cover. This can provide a flush support of the cover with the upper edge of the sidewalls of the base body or an internal/lower support of the cover relative to the upper edge of the sidewalls of the base body. According to one implementation, the distance between the internal elastic tension element and the upper edge of the sidewalls can be smaller than the thickness of the cover, whereby it protrudes/overhangs in a side view relative to the base body. This can favor a particularly secure attachment of the cover to the base body.

According to a particularly preferred implementation of the present innovation, the elastic tension element is aligned parallel to an upper edge of the sidewalls, which forms the opening.

According to a particularly preferred implementation of the present innovation, it is envisaged that the base body has at least three, ideally four sidewalls, on the inner sides of which the elastic element runs and at the edges or corners between the sidewalls, the elastic band runs on the outside.

Figure 2:
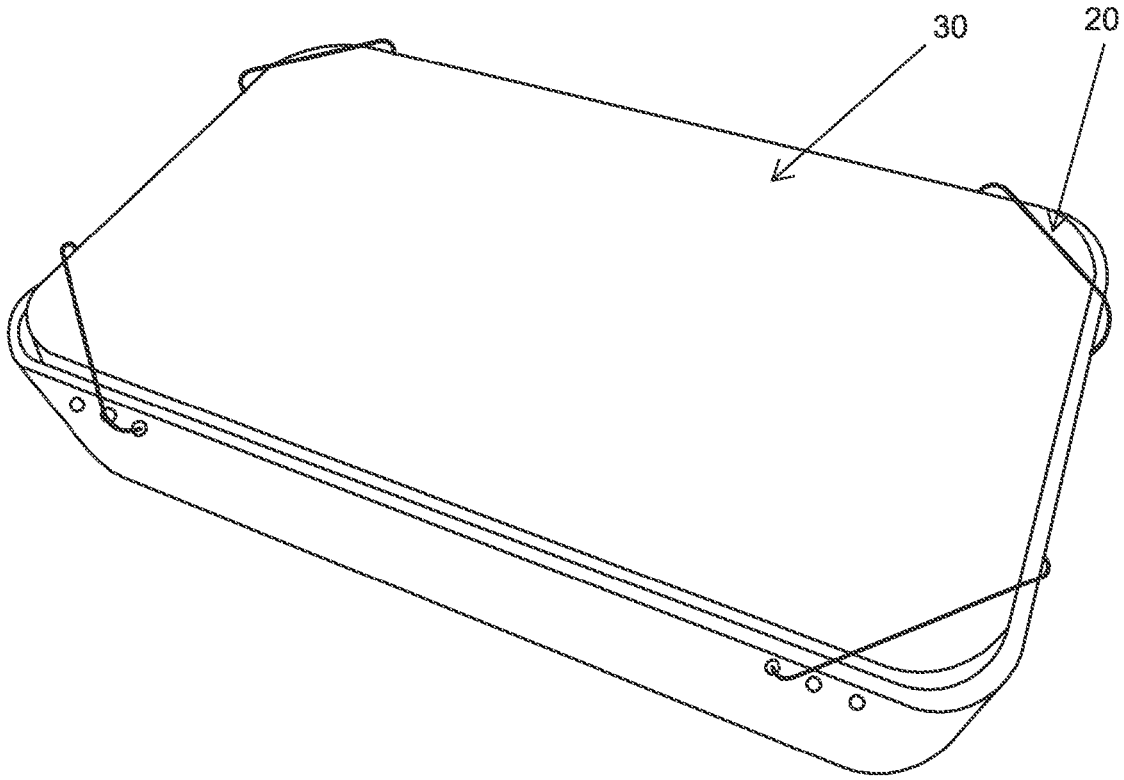
Figure 3:
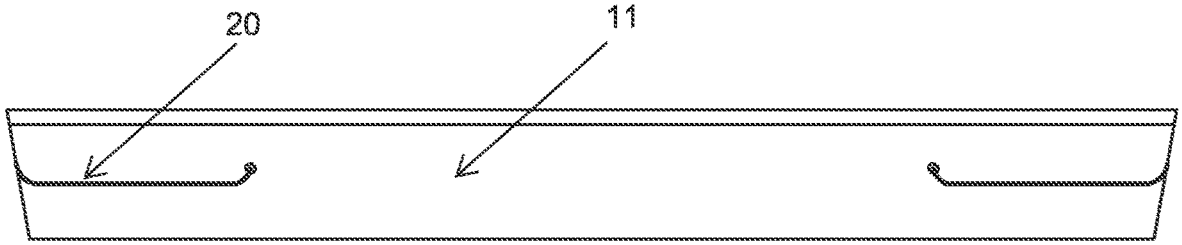
Figure 4:
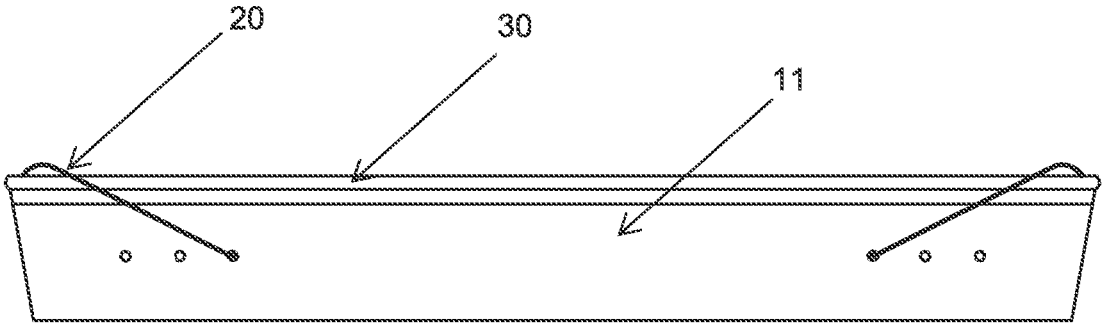
Figure 5:
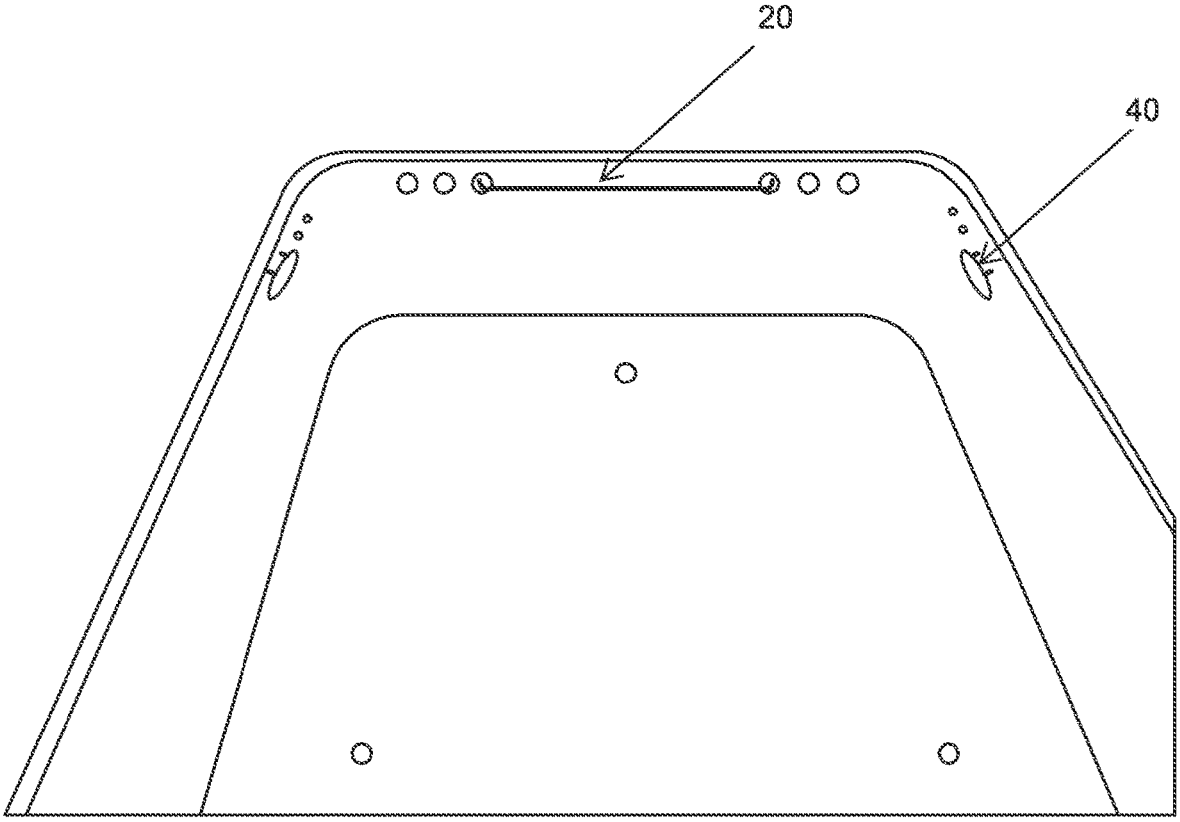
Figure 6:
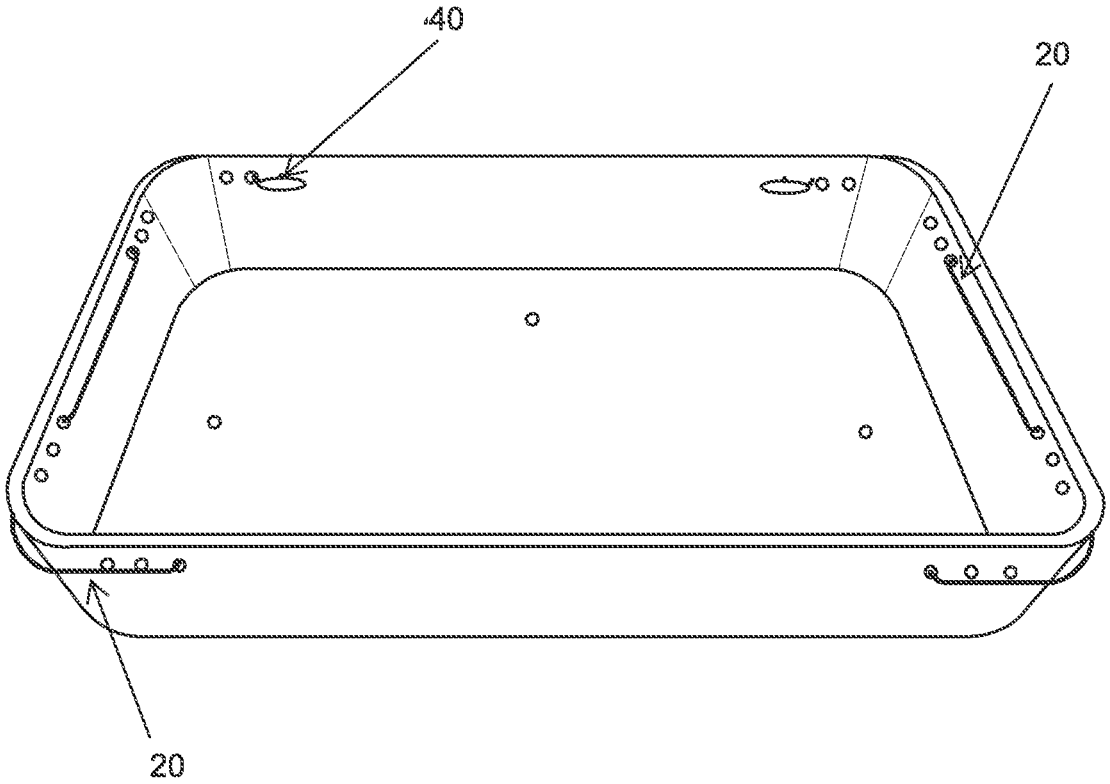
Figure 7:
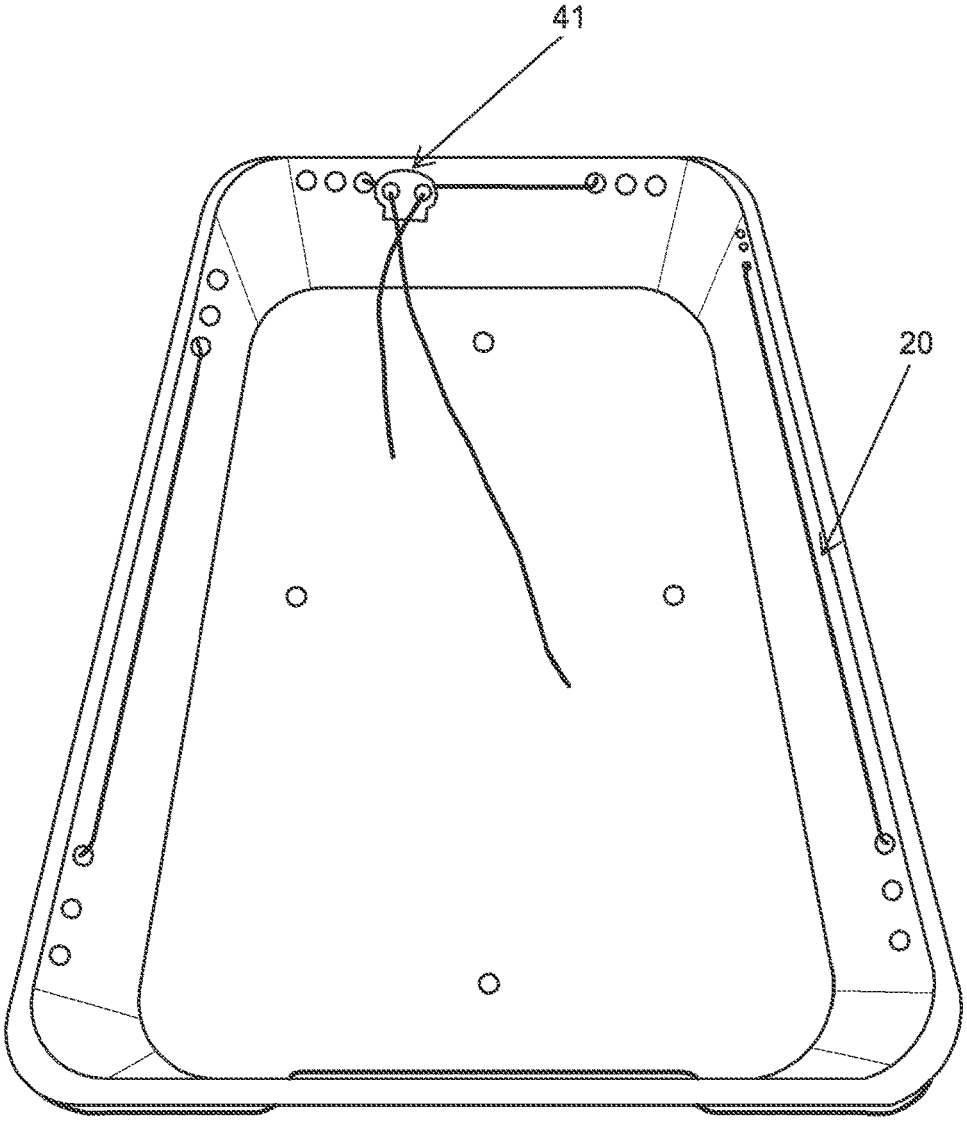

The innovation will be further explained below with the help of the attached drawings. They show:

FIG. 1 a perspective representation of the storage box according to the innovation without a cover, FIG. 2 a perspective representation of the storage box according to the innovation with a cover, FIG. 3 a side view of the storage box according to the innovation without a cover, FIG. 4 a side view of the storage box according to the innovation with a cover and overfolded elastic tension elements in the edge areas of the sidewalls, FIG. 5 a perspective interior view of the storage box according to the innovation with more than one elastic tension element, FIG. 6 a 90° rotated perspective representation of an implementation of the storage box according to the innovation and FIG. 7 a perspective representation of an implementation of the storage box according to the innovation with an alternative attachment option for the elastic tension element with a preferred adjustable preload.

FIG. 1 shows a perspective representation of the storage box 10 according to the innovation without a cover, in which an elastic tension element 20 is guided through recesses 12. The recesses 12 are provided in the sidewalls 11 and can be designed as holes or millings. In addition, further recesses 13 can be provided in a bottom area of the storage box, via which the storage box can be attached, for example, to a surface such as a wall.

As shown in FIG. 1, the elastic tension element is guided along the side walls 11 on an inner side of the storage box 10 and in the corner areas on an outer side. This provides support means for a cover 30 along the individual side walls through the internal areas of the elastic tension element 20.

FIG. 2 shows the storage box 10 according to the invention with a cover 30 arranged thereon, which is fixed on the storage box 10 over the elastic tension elements in the edge areas of the side walls. For this, the elastic tension elements 20 are turned over the cover 30 in the corner areas of the main body. As can be seen from FIGS. 1 and 2, several recesses 12 can be provided along a side wall 11, whereby an overlap length of the elastic element in the area of the edges of the storage box can be adjusted. The cover 30 rests on the internal elastic tension elements 20.

FIG. 3 shows a side view of the storage box 10 according to the invention, in which in an edge area, i.e. where two side walls 11 meet, the elastic tension element 20 is guided on an outer side of the side walls 11.

FIG. 4 is a side view according to FIG. 2, which shows how the elastic tension elements 20 are turned over the cover 30, which is located on the main body of the storage box 10, for its attachment.

FIG. 5 shows a perspective view of the inside of the main body of the storage box 10 according to the invention. According to an alternative design, the elastic tension element 20 is not continuous but is provided in sections along the side walls. One of the tension elements 20 with corresponding fastening bodies 40, which can be designed as thickening, is shown as representative. In principle, an elastic tension element 20 can also be guided along all side walls on their inner sides according to the design according to FIG. 5.

FIG. 6 shows a perspective view of the design of the storage box 10 according to the invention, rotated by 90° compared to FIG. 5, in which an elastic tension element is provided on opposite sides of the main body of the storage box 10. Each of the elastic tension elements has a fastening body 40 in their end areas, by means of which the elastic tension element is fixed in the recesses 12 of the main body. According to FIG. 6, there are shown just two elastic tension elements provided on opposite sides. In principle, according to the illustrated fastening method, elastic tension elements can also extend over more than one side or, for example, four separate elastic tension elements can be provided, which can each be provided on the main body of the storage box 10 by means of a fastening body 40.

FIG. 7 shows a special implementation of the present innovation, in which a single elastic tension element 20 is guided circumferentially and ornamentally in, on, and around the sidewalls of the storage box 10. The ends of the elastic tension element are fixed via a special fastening body 41, by means of which the preload of the elastic element can be adjusted. The special fastening body 41 can be provided with a spring-loaded locking member, which, when actuated, releases the ends of the elastic tension element 20 and is therefore adjustable in length. This allows the preload of the elastic tension element and thus its holding properties to be adjustable. The special element 41 for adjustable preload of the elastic tension element can also be provided when multiple elastic tension elements are provided in sections along the sidewalls, as can be seen, for example, from FIG. 6.

The invention claimed is:

1. A storage box comprising:

a base body, having sidewalls (11), a cover (30), and a fastening device for the cover, wherein the fastening device has at least one elastic tension element (20), wherein the cover (30) can be fixed to the storage box (10) by the tension element (20) and wherein the elastic tension element is guided partially on an inside of the sidewalls (11), wherein the cover (30) rests upon inside sections of the elastic tension element located on the inside of the sidewalls (11) such that the elastic tension element (20) is positioned beneath peripheral edge portions of the cover (30) and provides upward internal support to the cover (30), and wherein at corners of the cover (30) the elastic tension element (20) extends over and above the corners of the cover (30) to retain the cover (30) in position.

2. Storage box according to claim 1, wherein the elastic tension element (20) is guided through recesses (12) in the sidewalls (11) and is arranged in areas inside and outside the storage box so that the inside sections located inside the sidewalls support the cover upwardly and outside sections of the elastic tension element (20) outside the corners retain the cover downwardly.

3. Storage box according to claim 1, wherein the elastic tension element (20) includes sections which are inside and outside the storage box, wherein the cover can be fixed between the sections of the elastic tension element (20) such that the inside sections are beneath and support peripheral portions of the cover (30) and the outside sections extend over the corners of the cover (30).

4. Storage box according to claim 1, wherein the storage box includes corners located between the side walls of the storage box, wherein the elastic element is guided in the corners of the storage box on an outside of the storage box and passes over upper corner portions of the cover (30).

5. Storage box according to claim 1, wherein the elastic tension element (20) is arranged such that corner portions of the elastic tension element (20) are slipped over the corners of the cover (30) while intermediate portions of the elastic tension element (20) extend beneath and support peripheral edges of the cover (30).

6. Storage box according to claim 1, a single elastic tension element (20) is provided, which is guided through the recesses of the storage box to form alternating inside support sections and outside retention sections around the periphery of the cover (30).

7. Storage box according to claim 1, wherein at least one of the sections of the elastic tension element (20) extends laterally between two corners and is guided along an inner surface of the sidewall (11) so as to support the cover (30) from below.

8. Storage box according to claim 1, wherein the at least one elastic tension element (20) is arranged in an upper edge area below an opening of the storage box (10), wherein the height of the upper edge area corresponds approximately to the thickness or depth of the cover (30) so that the cover (30) seats flush with an upper rim of the storage box when supported by the elastic tension element (20).

9. Storage box according to claim 1, wherein the base body has at least three side walls (11), on the inside of which the elastic tension element (20) runs and at the edges or corners between the side walls (11) the elastic tension element (20) runs on the outside and above the corners of the cover (30).

10. Storage box according to claim 1, wherein the elastic tension element (20) and above the corners of the cover (30) includes corner sections extending over and above the cover (30) to fix the cover (30) to the base body and intermediate sections positioned beneath peripheral portions of the cover (30).

11. Storage box according to claim 1, wherein the cover (30) is positioned inside the base body.

12. Storage box according to claim 1, wherein the elastic tension element (20) includes sections which are inside and outside the storage box, wherein the cover (30) rests upon sections of the elastic tension element located on the inside of opposing sidewalls (11) in a fixed position and is held down at the corners by portions of the elastic tension element (20) extending over the corners of the cover (30).

* * * * *